United States Patent [19]

Reiling et al.

[11] 4,420,908

[45] Dec. 20, 1983

[54] BUFFING WHEEL

[76] Inventors: Reinhold Reiling; Karl Reiling, both of Grundeltorstrasse 9, Kämfelbach-Ersingen, Fed. Rep. of Germany

[21] Appl. No.: 311,543

[22] Filed: Oct. 15, 1981

[30] Foreign Application Priority Data

Oct. 15, 1980 [DE] Fed. Rep. of Germany ..... 3038850

[51] Int. Cl.[3] ..... B24B 23/02

[52] U.S. Cl. ..... 51/170 T; 15/28; 15/97 R; 15/180; 51/177; 51/180

[58] Field of Search ..... 51/170 R, 170 T, 180, 51/170 PT, 177; 15/28, 97 R, 180, 230.17

[56] References Cited

U.S. PATENT DOCUMENTS

| | | | |
|---|---|---|---|
| 2,390,226 | 12/1945 | Smith | 51/170 PT |
| 2,993,311 | 7/1961 | West | 51/170 T |
| 4,202,067 | 5/1980 | Stamatovic | 51/170 T |

*Primary Examiner*—Roscoe V. Parker

*Attorney, Agent, or Firm*—Balogh, Osann, Kramer, Dvorak, Genova & Traub

[57] ABSTRACT

The buffing wheel comprises a wheel body, abrasive-containing flexible material secured to the wheel body, and a drive shaft non-rotatably connected to the wheel body. The drive shaft comprises a flexible portion. A rigid member is carried by said drive shaft and slidable relative thereto between an inoperative position, in which said drive shaft is flexible, and a stiffening position, in which said rigid member stiffens said drive shaft.

14 Claims, 4 Drawing Figures

BUFFING WHEEL

This invention relates to a buffing wheel for grinding or polishing, comprising a wheel body, a buffing cloth carried by said wheel body, and a drive shaft secured to said wheel body and adapted to be gripped in a drive chuck, particularly of a hand-held drilling machine or a machine-tool for use by hobbyists.

In known buffing wheels of that type, the buffing cloth is detachably secured to the wheel body by pressure-sensitive adhesive or a Velcro fastener. Those known buffing wheels have a rigid drive shaft, which is adapted to be gripped in a chuck of a hand-held drilling machine or a machine tool for hobbyists. Whereas such buffing wheels can be used to grind and polish edges, they are not well adapted for surface grinding and polishing work because when the wheel is even slightly canted it will cut recesses or grooves into the surface that is being abraded. That danger cannot be eliminated even by the use of a resilient wheel body.

It is an object of the invention to provide a tool which can be used satisfactorily for surface grinding and polishing as well as for a grinding and polishing of edges.

In a buffing wheel comprising a wheel body, a buffing cloth carried by said wheel body and a drive shaft secured to the wheel body and adapted to be gripped in a drive chuck, this object is accomplished in that the drive shaft is flexible at least in part and is adapted to be stiffened by means of a rigid sleeve or insert. As a result, the buffing wheel can be flexibly or rigidly held, as desired.

The sleeve may consist of a tube and the insert may consist of a rod. Alternatively, the stiffening sleeve may consist of a sleeve nut, which is adapted to be screwed to screw-threaded fittings mounted on the flexible drive shaft. Stops are suitably provided, which limit the extent to which the flexible shaft can be laterally deflected. Such stops may be constituted by spaced apart screw-threaded fittings mounted on the flexible shaft. In such an arrangement, the wheel body is secured by means of a flange and a fixing sleeve nut to one of the screw-threaded fittings. The stiffening sleeve nut is adapted to be screwed only to the other of said fittings when said drive shaft is to be flexible, or to both said fittings when said drive shaft is to be stiffened.

Figures 1, 2, 3:
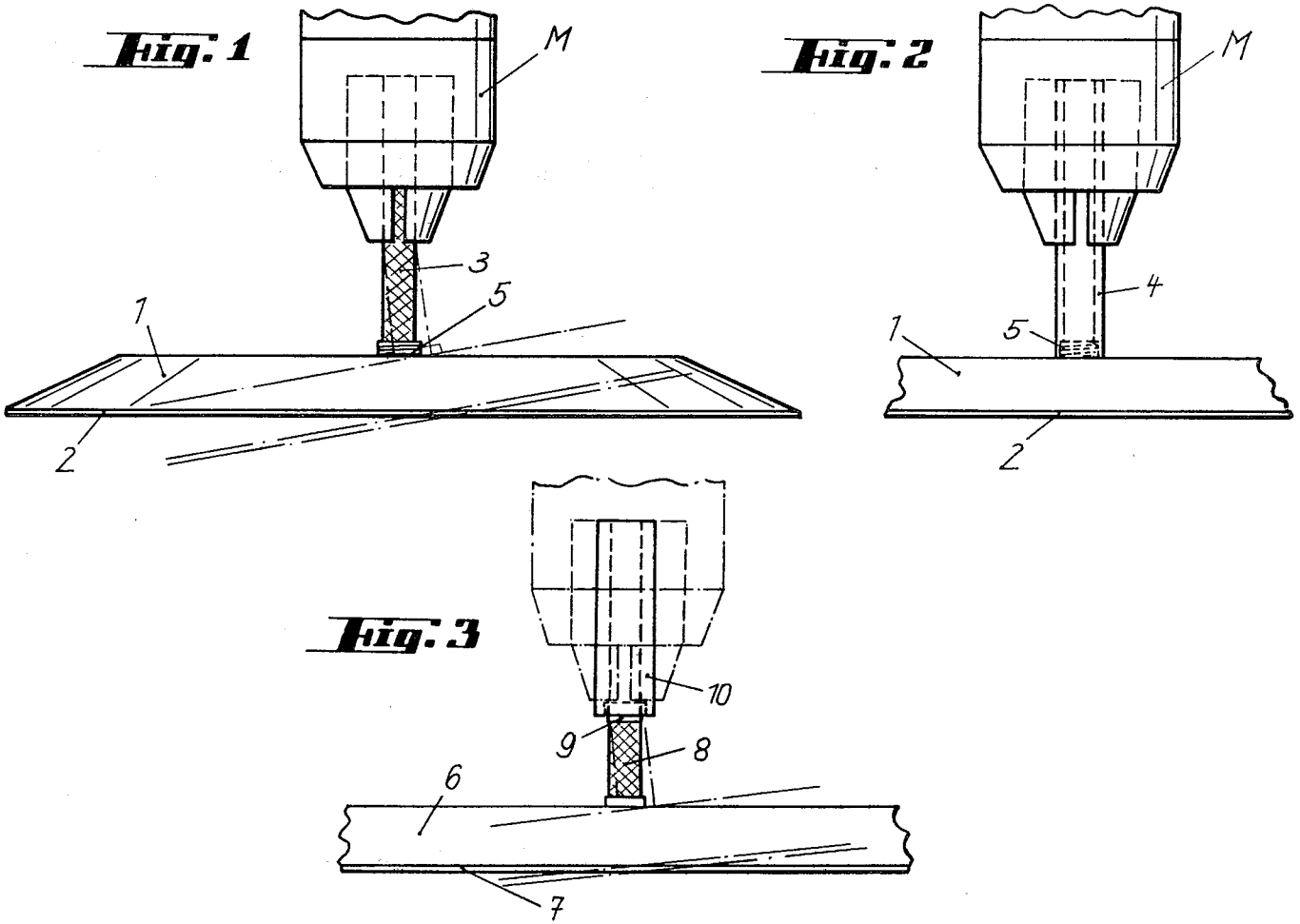
Figure 4:
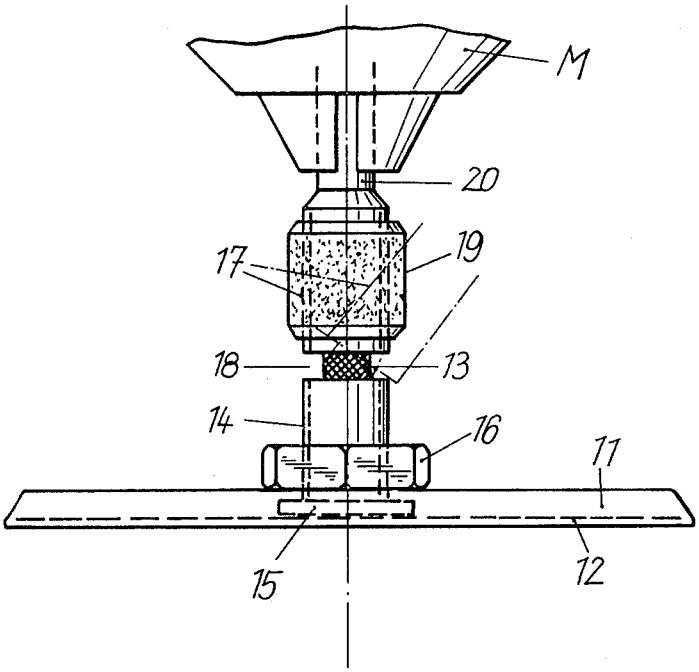

Further details of preferred embodiments of the invention will now be described with reference to the diagrammatic drawings, in which FIG. 1 is a diagrammatic overall view showing a buffing wheel provided with a flexible shaft adapted to be gripped in a drive chuck, FIG. 2 is an elevation showing part of the wheel of FIG. 1 provided with a rigid stiffening sleeve that is adapted to be gripped in the drive chuck, FIG. 3 is an elevation showing a drive shaft consisting of a flexible section and a rigid one, and FIG. 4 is a diagrammatic overall view showing another buffing wheel having a flexible drive shaft.

In the first embodiment shown in FIGS. 1 and 2, the buffing wheel consists of a wheel body 1 and an abrasive-containing woven fabric 2, which is detachably secured to the wheel body 1 by a pressure-sensitive adhesive or a Velcro fastener. In the embodiment shown in FIG. 1, a flexible drive shaft 3 is connected to the wheel body 1 and adapted to be gripped in a drive chuck of a machine M consisting of a hand-held drilling machine or a machine tool for use by hobbyists. In accordance with FIG. 2, the flexible drive shaft 3 is surrounded by a rigid tube 4, which has been screwed to the screw-threaded fitting 5 provided at the joint between the flexible shaft 3 and the wheel body 1. It is apparent that this buffing wheel can be used with a flexible or with a rigid drive shaft so that one and the same wheel can be used for surface buffing or edge buffing.

In the second embodiment shown in FIG. 3, the buffing wheel comprises a wheel body 6 and an abrasive-containing woven fabric 7, which is secured to the wheel body 6, a drive shaft is connected to the wheel body 6 and adapted to be gripped in a drive chuck of a machine M consisting of a hand-held drilling machine or a machine tool for use by hobbyists and consists of a flexible shaft portion 8 and a rigid shaft portion 9. A rigid tube 10 is slidably mounted on the two shaft portion 8 and 9 and can be fixed in position, e.g., by screwing.

Instead of a rigid tube slidably mounted on the drive shaft, the means for stiffening the flexible drive shaft may consist of a rigid rod, which is adapted to be slidably inserted into a hollow flexible shaft. The rod may be screw-threadedly fixed at one end or may simply be fitted firmly in a suitable sleeve member. At the protrudind portion of flexible shaft, the rod may be provided with a flange or with a sleeve surrounding the hollow shaft and said flange or sleeve may then be gripped in the drive chuck.

A particularly preferred embodiment is shown in FIG. 4 and instead of a conventional flexible wheel body comprises a rigid wheel body 1 of hard plastic material or preferably of steel. An abrasive-containing woven fabric 12 is secured to the wheel body 1. A flexible drive shaft 13 is provided at one end with a screw-threaded fitting 14, on which the wheel body 11 is held between a flange 15 of the fitting 14 and a sleeve nut 16 screwed on the fitting. A second screw-threaded fitting 17 is fixed to the flexible shaft 13 and spaced by a distance 18 from the fitting 14. A sleeve nut 19 is adapted to be screw-threadedly connected only to the screw-threaded fitting 17 so that the sleeve nut 19 will then be in an upper position and the two screw-threaded fittings 14, 17, will constitute stops limiting the extent to which the flexible shaft can be deflected. The flexible shaft can be stiffened in that the sleeve nut 19 in a lower position is screw-threadedly connected to both screw-threaded fittings 14, 17. That buffing wheel can be used for surface buffing with a flexible shaft and for edge buffing with a stiffened, rigid shaft so that there is no need to replace the tool between the two operations.

Just as in the first and second embodiments, the shaft has rigid end portion 20 that is adapted to be gripped in the drive chuck of a machine M, which may consist of a hand-held drilling machine or a machine tool for hobbyists.

What is claimed is:

1. In a buffing wheel comprising a wheel body, abrasive-containing flexible material secured to said wheel body, and a drive shaft non-rotatably connected to said wheel body, the improvement residing in that said drive shaft comprises a flexible portion and a rigid member is mounted on said drive shaft and slidable relative thereto between an inoperative position, in which said drive shaft is flexible, and a stiffening position, in which said rigid member stiffens said drive shaft.

2. The improvement set forth in claim 1, wherein said rigid member comprises a sleeve, which surrounds said drive shaft.

3. The improvement set forth in claim 1, wherein
said drive shaft is hollow and
said rigid member comprises a rod that is slidably mounted in said drive shaft.

4. The improvement set forth in claim 1, wherein
said flexible portion of said drive shaft is joined to said wheel, body,
a screw-threaded fitting is secured to said wheel body at said flexible portion and
said rigid member has a screw-threaded end portion which faces said wheel body and is adapted to be screwed to said screw-threaded fitting.

5. The improvement set forth in claim 4, wherein
said rigid member comprises a sleeve which surrounds said drive shaft and
said screw-threaded fitting surrounds said drive shaft.

6. The improvement set forth in claim 4, wherein
said drive shaft is hollow and surrounds said screw-threaded fitting and
said rigid member comprises a rod that is slidably mounted in said drive shaft.

7. The improvement set forth in claim 1, wherein
longitudinally spaced apart, first and second screw-threaded fittings are secured to said drive shaft,
said flexible portion of said drive shaft is disposed between said first and second screw-threaded fittings and
said rigid member comprises a stiffening sleeve nut, which is adapted to be screwed to both said screw-threaded fittings.

8. The improvement set forth in claim 7, wherein said first and second screw-threaded fittings are adapted to cooperate so as to limit the extent to which said flexible portion can be deflected.

9. The improvement set forth in claim 8, wherein
said first screw-threaded fitting has a flange,
a fixing sleeve nut is screw-threadedly connected to said first screw-threaded fitting,
said wheel body is held on said first screw-threaded fitting between said fixing sleeve nut and said flange, and
said stiffening sleeve nut is adapted to be screwed to said second screw-threaded fitting so that said stiffening sleeve nut is clear of said first screw-threaded fitting.

10. The improvement set forth in claim 1, wherein
said drive shaft carries two longitudinally spaced apart stops, which are adapted to cooperate so as to limit the extent to which said flexible portion can be deflected.

11. The improvement set forth in claim 1, wherein
said dirve shaft comprises a rigid portion and
said rigid member is adapted to be secured to said rigid portion in said inoperative position.

12. The improvement set forth in claim 1, wherein said wheel body is rigid.

13. The improvement set forth in claim 12, wherein said wheel body consists of plastic material.

14. The improvement set forth in claim 12, wherein said wheel body consists of steel.

* * * * *